US011118404B2

(12) United States Patent
Leismer et al.

(10) Patent No.: US 11,118,404 B2
(45) Date of Patent: Sep. 14, 2021

(54) SYSTEM AND METHOD FOR REVERSE Y-TOOL BYPASS

(71) Applicant: ACCESSESP UK LIMITED, Great Yarmouth (GB)

(72) Inventors: Dwayne Leismer, Houston, TX (US); Rogelio Cantu, Houston, TX (US)

(73) Assignee: ACCESSESP UK LIMITED, Great Yarmouth (GB)

( * ) Notice: Subject to any disclaimer, the term of this patent is extended or adjusted under 35 U.S.C. 154(b) by 95 days.

(21) Appl. No.: 16/548,713

(22) Filed: Aug. 22, 2019

(65) Prior Publication Data

US 2020/0157898 A1 May 21, 2020

Related U.S. Application Data

(60) Provisional application No. 62/703,406, filed on Jul. 25, 2018.

(51) Int. Cl.

| | |
|---|---|
| ***E21B 7/08*** | (2006.01) |
| ***E21B 7/06*** | (2006.01) |
| ***E21B 23/12*** | (2006.01) |
| ***E21B 23/03*** | (2006.01) |
| *E21B 43/12* | (2006.01) |
| *E21B 47/10* | (2012.01) |
| *E21B 47/06* | (2012.01) |
| *E21B 33/12* | (2006.01) |
| *E21B 47/07* | (2012.01) |

(52) U.S. Cl.

CPC ..... *E21B 7/061* (2013.01); *E21B 23/03* (2013.01); *E21B 23/12* (2020.05); *E21B 33/12* (2013.01); *E21B 43/128* (2013.01); *E21B 47/06* (2013.01); *E21B 47/07* (2020.05); *E21B 47/10* (2013.01)

(58) Field of Classification Search

CPC ..... E21B 41/0035; E21B 23/12; E21B 47/07; E21B 47/06; E21B 33/12; E21B 43/128; E21B 47/10; E21B 23/03; E21B 17/18; E21B 7/061

See application file for complete search history.

(56) References Cited

U.S. PATENT DOCUMENTS 5,960,873 A * 10/1999 Alexander ..... E21B 29/06 166/50
2008/0223585 A1* 9/2008 Patel ..... E21B 43/128 166/385

(Continued)

*Primary Examiner* — Brad Harcourt
(74) *Attorney, Agent, or Firm* — Gordon G. Waggett, P.C.

(57) ABSTRACT

A system and method for deploying a reverse Y-tool are provided. The system and method may include a first tubing branch in line with production tubing and a second tubing branch offset from the first tubing branch. The Y-tool system may also have a retrievable Electric Submersible Pump (ESP) and an orienting whipstock deployed in the first tubing branch. The orienting whipstock may direct other wellbore components to the second tubing branch. The radius of the second tubing branch is less than a radius of the first tubing branch. A reverse Y-tool mandrel is also provided that includes an upper head comprising an upper connection to production tubing, a middle body comprising a discriminating section profile, and a bottom section comprising a lower connection to production tubing and a lower connection to bypass tubing.

24 Claims, 11 Drawing Sheets

(56) References Cited

U.S. PATENT DOCUMENTS

| | | | | |
|---|---|---|---|---|
| 2015/0345264 | A1* | 12/2015 | Johnson | E21B 43/128 166/311 |
| 2016/0312584 | A1* | 10/2016 | Hazel | E21B 43/14 |
| 2018/0066479 | A1* | 3/2018 | Head | E21B 17/023 |
| 2018/0328148 | A1* | 11/2018 | Glaser | E21B 17/026 |
| 2019/0120021 | A1* | 4/2019 | Steele | E21B 41/0035 |

* cited by examiner

SYSTEM AND METHOD FOR REVERSE Y-TOOL BYPASS

CROSS-REFERENCE TO RELATED APPLICATIONS

This application claims the benefit of the filing date of and priority to: U.S. Provisional Application Ser. No. 62/703,406 entitled "System and Method for Reverse Y-Tool Bypass" and filed Jul. 25, 2018, Confirmation No. 6339; said provisional application is incorporated by reference herein in its entirety for all purposes.

STATEMENT REGARDING FEDERALLY SPONSORED RESEARCH OR DEVELOPMENT

Not Applicable.

BACKGROUND OF THE INVENTION

The following descriptions and examples are not admitted to be prior art by virtue of their inclusion in this section.

In oil and gas wells, Electrical Submersible Pumps (ESPs) are often used to retrieve oil when natural production is non-existent or below the desired rate. These ESP systems are typically installed as part of the production tubing, therefore blocking access to the bottom of the well and thus preventing the use of well logging tools or intervention equipment below the system.

It is sometimes desired by an operator to record wellbore data or perform intervention work while an ESP system is installed, and sometimes even when the ESP is running. To allow an operator to perform these actions, the ESP industry has created a Y-tool. A Y-tool consists of a device on which the production tubing is attached on its upper end. The bottom end of the Y-tool may be divided in two bores, one in-line with the upper production tubing, and another offset to one side. The ESP system is typically attached to the offset side of the Y-tool, allowing open bore access to the main production tubing.

A retrievable ESP system has a semi-permanent mandrel component attached to the production tubing, and a slickline, wireline, or coiled tubing-retrievable component comprising primarily of a motor, submersible pump, seals, and running equipment. If a Y-tool type of equipment is to be used with a retrievable ESP system, the ESP needs to be attached in-line with the production tubing in order to allow the installation and removal of the ESP components.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

An embodiment of the claimed disclosure may comprise a reverse Y-tool system including a first tubing branch in line with production tubing and a second tubing branch offset from the first tubing branch and configured to releasably couple with a production plug or a survey plug. The Y-tool system may further include a retrievable Electric Submersible Pump (ESP) deployed in the first tubing branch and an orienting whipstock deployed in the first tubing branch downstream of the retrievable ESP and configured to direct other wellbore components to the second tubing branch. In this embodiment, a radius of the second tubing branch is less than a radius of the first tubing branch. In another embodiment, the reverse Y-tool system may further comprise a wet connector mandrel for providing power to the retrievable ESP. In another embodiment, the reverse Y-tool system may further comprise an ESP power line electrically coupled to the wet connector mandrel. In another embodiment, the reverse Y-tool system may further comprise a completion section provided in the first tubing branch.

Another embodiment of the claimed disclosure may comprise a reverse Y-tool mandrel including an upper head comprising an upper connection to production tubing, a middle body comprising a discriminating section profile, and a bottom section comprising a lower connection to production tubing and a lower connection to bypass tubing. In this embodiment, the upper head may further comprise a re-entry ramp. Also in this embodiment, the bottom section may further comprise an orienting profile. The bottom section may also further comprise a locking profile for an orienting whipstock. The reverse Y-tool mandrel of this embodiment may also further comprise a production flow channel in an exterior circumference.

Still other embodiments of the claimed disclosure may include a method for deploying a reverse Y-tool system. The method may involve completing a well with a reverse Y-tool mandrel coupled to production tubing, a completion section, and a wet connector mandrel and deploying a retrievable Electric Submersible Pump (ESP) downhole via a main branch of a reverse Y-tool mandrel until the retrievable ESP is coupled to the wet connector mandrel. Additionally, the method may further include deploying an orienting whipstock downhole via a main branch of a reverse Y-tool mandrel above the retrievable ESP, and deploying a production plug downhole into a bypass bore. The step of deploying the orienting whipstock may further included engaging an orienting profile with a guiding key. In one embodiment, the step of engaging the orienting profile with the guiding key may further comprise the steps of: engaging the orienting whipstock with an upper profile lock; activating the guiding key from the orienting whipstock; engaging the guiding key with the orienting profile; and engaging the orienting whipstock with a lower profile lock. In another embodiment, the step of engaging the orienting profile with the guiding key may comprise resiliently activating the guiding key to protrude from the orienting whipstock. In yet another embodiment, the step of engaging the orienting profile with the guiding key may comprise activating the guiding key by manipulating a sliding sleeve to release the guiding key. In this method, the retrievable ESP may be powered from a remote location via the wet connector mandrel. In this method, the production plug may be directed into the bypass bore by the orienting whipstock.

Yet another embodiment of the claimed disclosure may comprise a method for logging a well including deploying a reverse Y-tool system, removing a production plug, and deploying a logging string and survey plug downhole. The method may further include engaging the survey plug with a bypass bore locking profile, releasing the logging string from the survey plug, and deploying the logging string to a desired depth and log conditions. This method may further comprise the step of directing the logging string and survey plug into a bypass bore via an orienting whipstock. The log conditions may be logged during production. The log conditions may include, for example, at least one of wellbore temperature, wellbore pressure, or flow rate of borehole fluid.

Other or alternative features will become apparent from the following description, from the drawings, and from the claims.

BRIEF DESCRIPTION OF THE SEVERAL VIEWS OF THE DRAWINGS

Certain embodiments will hereafter be described with reference to the accompanying drawings, wherein like reference numerals denote like elements. It should be understood, however, that the accompanying drawings illustrate only the various implementations described herein and are not meant to limit the scope of various technologies described herein. The drawings are as follows.

DETAILED DESCRIPTION

Figure 1:
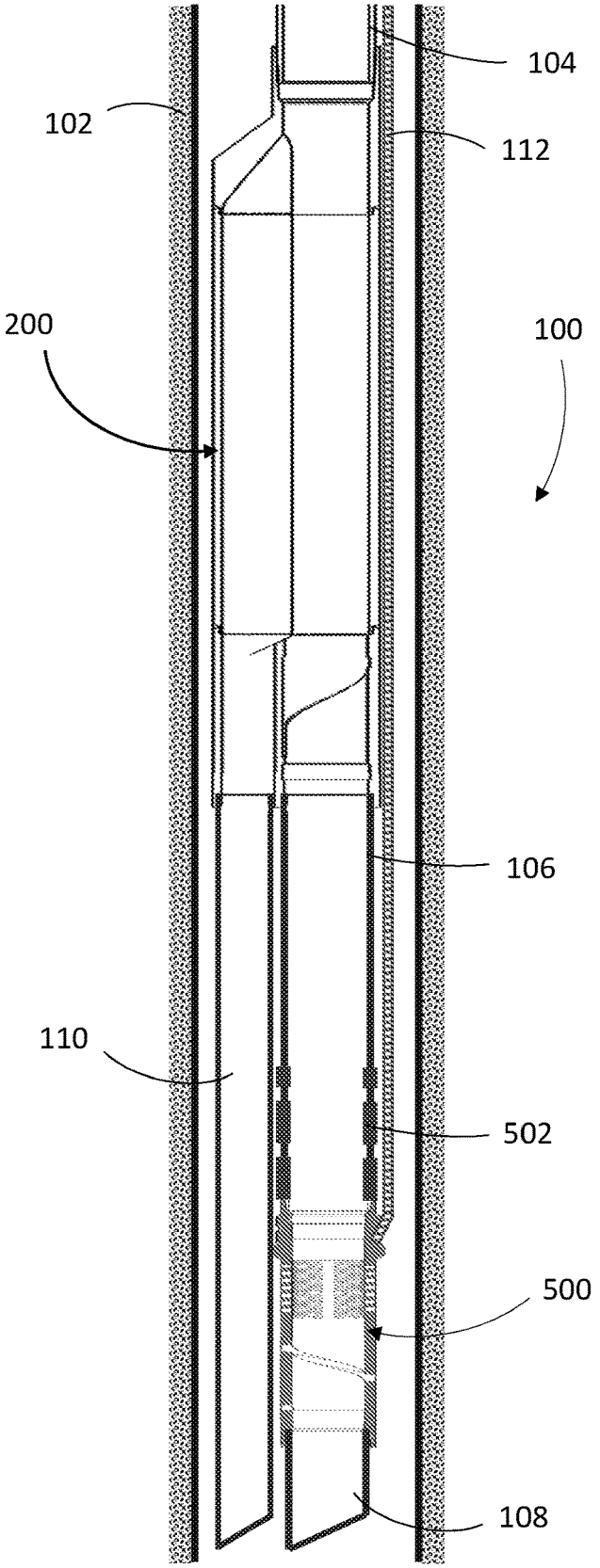
FIG. 1 is a cross-sectional view of a reverse Y-tool system during completion, according to an embodiment of the disclosure.

Reference throughout the specification to "one embodiment," "an embodiment," "some embodiments," "one aspect," "an aspect," or "some aspects" means that a particular feature, structure, method, or characteristic described in connection with the embodiment or aspect is included in at least one embodiment of the present disclosure. Thus, the appearance of the phrases "in one embodiment" or "in an embodiment" or "in some embodiments" in various places throughout the specification are not necessarily all referring to the same embodiment. Furthermore, the particular features, structures, methods, or characteristics may be combined in any suitable manner in one or more embodiments. The words "including" and "having" shall have the same meaning as the word "comprising."

As used throughout the specification and claims, the term "downhole" refers to a subterranean environment, particularly in a wellbore. "Downhole tool" is used broadly to mean any tool used in a subterranean environment including, but not limited to, a logging tool, an imaging tool, an acoustic tool, a permanent monitoring tool, and a combination tool. For purposes of this disclosure, when any one of the terms wireline, cable line, slickline or coiled tubing or conveyance is used it is understood that any of the referenced deployment means, or any other suitable equivalent means, may be used with the present disclosure without departing from the present disclosure.

Moreover, inventive aspects lie in less than all features of a single disclosed embodiment. Thus, the claims following the Detailed Description are hereby expressly incorporated into this Detailed Description, with each claim standing on its own as a separate embodiment.

As stated in the Background section, a retrievable Electric Submersible Pump (ESP) system has a semi-permanent mandrel component attached to the production tubing, and a slickline, wireline, or coiled tubing-retrievable component comprising a motor, submersible pump, seals, and running equipment. If a Y-tool class of equipment is to be used with a retrievable ESP system, the ESP needs to be attached in-line with the production tubing to allow the installation and the removal of the ESP components. Embodiments reflecting the in-line mounting of the ESP may be referred to herein as a Reverse Y-tool method and system, to reflect one difference with a Y-tool.

Mounting the ESP in-line with the production tubing may present a challenge when downhole equipment is run, for example, such as the running of production logging tools. Some of the production logging tool strings may extend several feet in length. In addition, the production logging tools may need to be deployed below the ESP setting depth while the ESP is in operation to properly determine the flow rates and other information that operators may need. Accordingly, embodiments of Reverse Y-tools as disclosed herein may comprise additional features to align and accommodate the production logging tool string in the proper bore. Some of these features will be described in more detail in the following.

Embodiments of this disclosure may comprise a system and a method for deployment. Elements of some of the embodiments may include a reverse Y-tool mandrel, a whipstock orienting tool, a retrievable ESP assembly, a permanent wet connect mandrel assembly, and a running bypass bore plug. These elements will be described in more detail as follows.

Referring generally to FIG. 1, this drawing shows an illustrative cross-section of a reverse Y-tool system 10 installation during completion of a well. In this example, the reverse Y-tool system 10 has been installed in a wellbore 100 fitted with a casing 102. The reverse Y-tool system 10 has been coupled to production tubing 104.

The reverse Y-tool system 10 may comprise a reverse Y-tool mandrel 200, coupled to the production tubing 104 at one end. A bypass bore 110 and a lower section of production tubing 106 may be coupled at the other end of the Y-tool mandrel 200.

The lower section of production tubing 106 is largely in line with the production tubing 104 attached to the other end of the reverse Y-tool mandrel 200. The bypass bore 110 may be run substantially parallel to the lower section of production tubing 106 but offset from both the production tubing 104 and the lower section of production tubing 106. In addition to being offset from the lower section of production tubing 106, the bypass bore 110 may be a different size than the production tubing. The size difference can aid in routing other components as they are positioned or travel downhole.

A completion section 502 may be provided below the lower section of production tubing 106. The completion section 502 may comprise various components such as centralizing joints and in some embodiments, a gas venting sub, as appropriate.

Below the completion section 502 is a Wet Connector Mandrel (WCM) 500 fitted with an ESP power line 412. The WCM 500 is configured to provide electrical power to a retrievable ESP assembly 400 (see FIG. 2). The ESP power line 412 may provide power to the ESP assembly 400 from a remote location, such as the surface for example.

In some embodiments, another section of production tubing 108 may be positioned below the WCM 500. In this illustrative example, production tubing 108 is shown as being open at the bottom. This configuration allows production fluids to enter into production tubing 108 and travel up hole within the existing network of production tubing.

Figure 2:
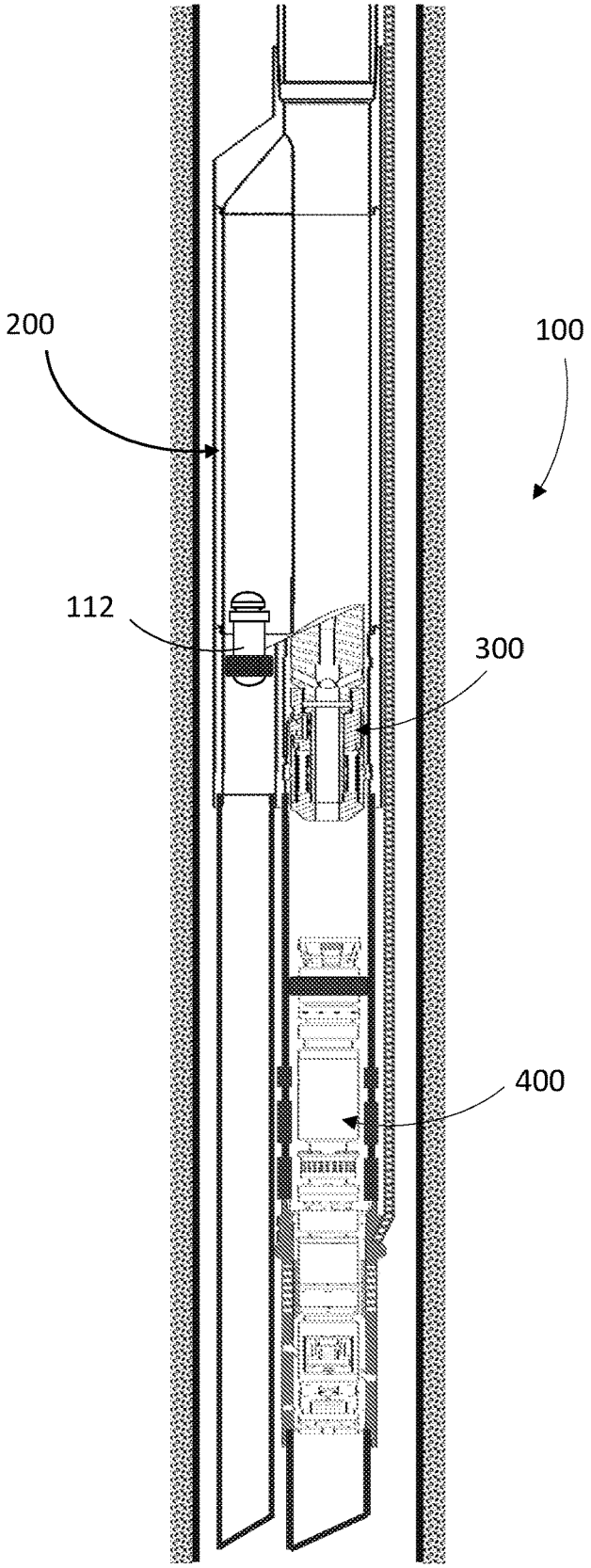
FIG. 2 is a cross-sectional view of the reverse Y-tool system of FIG. 1, but including additional production components, according to an embodiment of the disclosure.

Turning now to FIG. 2, this illustration shows the reverse Y-tool system 10 completion from FIG. 1 fitted with a retrievable ESP assembly 400, an orienting whipstock tool 300, and a production plug 112. Embodiments of this configuration could be considered as a production configuration, as this is how the wellbore would be fitted for production.

In order to arrive at this configuration of the reverse Y-tool system 10, the retrievable ESP assembly 400 needs to be installed initially. The retrievable ESP assembly 400 would pass through the production tubing 104, lower section of production tubing 106, and be positioned just above the production tubing 108, depending upon the completion needs of the well. Since production tubing 104 and the lower section of production tubing 106 are generally aligned to one another, the retrievable ESP 400 does not have to navigate tight or sharp turns.

In addition, since the bypass tubing 110 and the production tubing 104 and the lower section of production tubing 106 are different sizes, the reverse Y-tool mandrel 200 may maintain the motion of the retrievable ESP 400 in a substantially straight line, without the retrievable ESP 400 being able to enter into the bypass tubing 110.

The retrievable ESP 400 may be concurrently placed with the WCM 500 and electrically coupled together. Accordingly, retrievable ESP 400 may be powered from a remote location via ESP power line 412. Since the retrievable ESP 400 is retrievable, the WCM 500 connection may be made and broken again as required and as familiar to those of knowledgeable skill in the art.

After the retrievable ESP 400 is installed, an orienting whipstock 300 is installed. The orienting whipstock 300 may be located above the retrievable ESP 400 and functions to direct other components traveling downhole into the bypass tubing 110. As seen in this illustrative example, a cross-section of the orienting whipstock 300 shows an angled surface sloping towards the bypass bore 110.

With the retrievable ESP 400 and the orienting whipstock 300 installed, next is a production plug 112. The production plug 112 is sent downhole and interacts with the orienting whipstock 300 to be directed to the bypass bore 110.

The production plug 112 is then installed and secured onto the bypass bore 110 section. The production plug 112 functions to prevent any backflow and recirculation to the retrievable ESP pump 400 through the bypass bore 110.

Figure 3A:
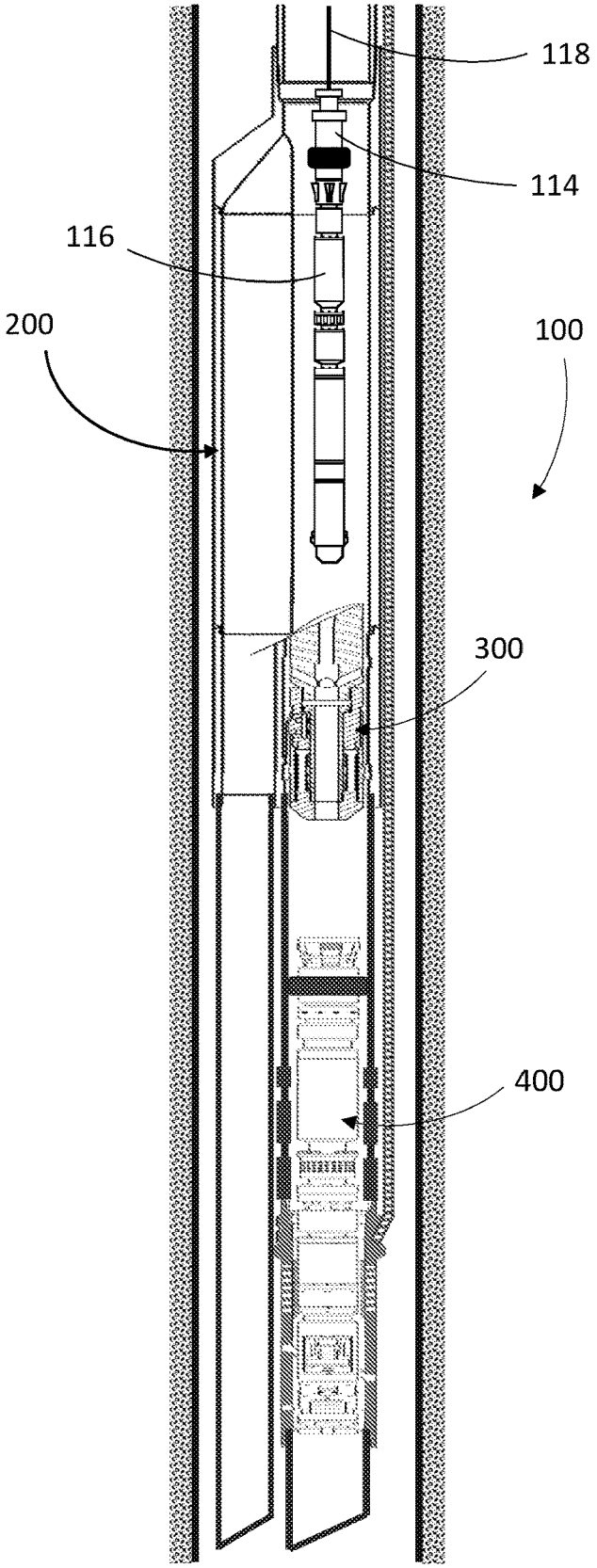
FIG. 3A is a cross-sectional view of the reverse Y-tool system showing the production plug removed and a logging string entering through the top of the reverse Y-tool mandrel, according to an embodiment of the disclosure.

Referring generally to FIG. 3A, this drawing shows an embodiment of the completion as described with the previous figure, but with the production plug 112 removed. Removal of the production plug 112 allows for a logging string 116 attached to a cable 118 to be deployed into the bypass bore 110 while the retrievable ESP assembly 400 is still in place. The logging string 116 can be seen at the top of the figure, having just entered into the reverse Y-tool mandrel 200.

Figure 3B:
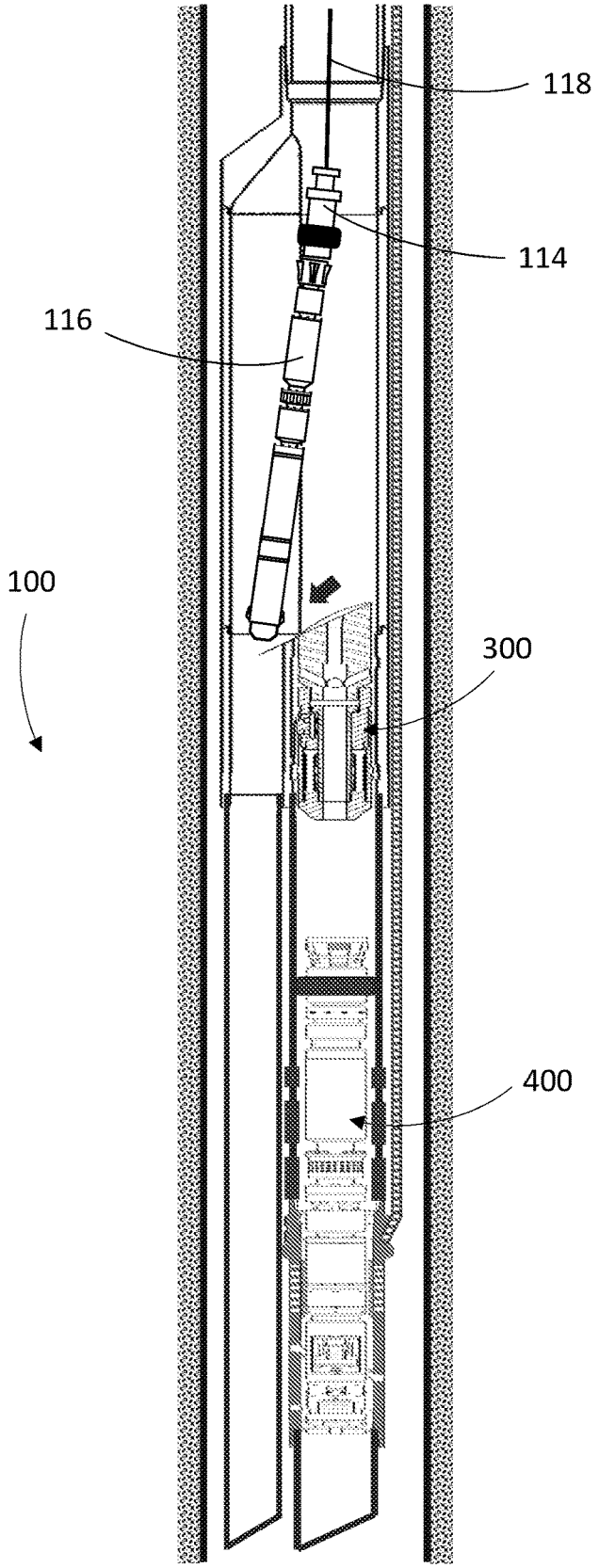
FIG. 3B is a cross-sectional view of the reverse Y-tool system showing the logging string engaging the orienting whipstock and being directed to the bypass bore, according to an embodiment of the disclosure.

As illustratively shown in FIG. 3B, a distal end (i.e., the lower most end) of the logging string 116 contacts an upper angled surface of the orienting whipstock 300. The orienting whipstock assembly 300 functions to guide the logging string 116 into the bypass bore 110. In addition, the logging string 116 has a smaller diameter than either the orienting whipstock 300 or the retrievable ESP pump 400. This allows the logging string 116 to be accommodated by the bypass bore 110.

Figure 3C:
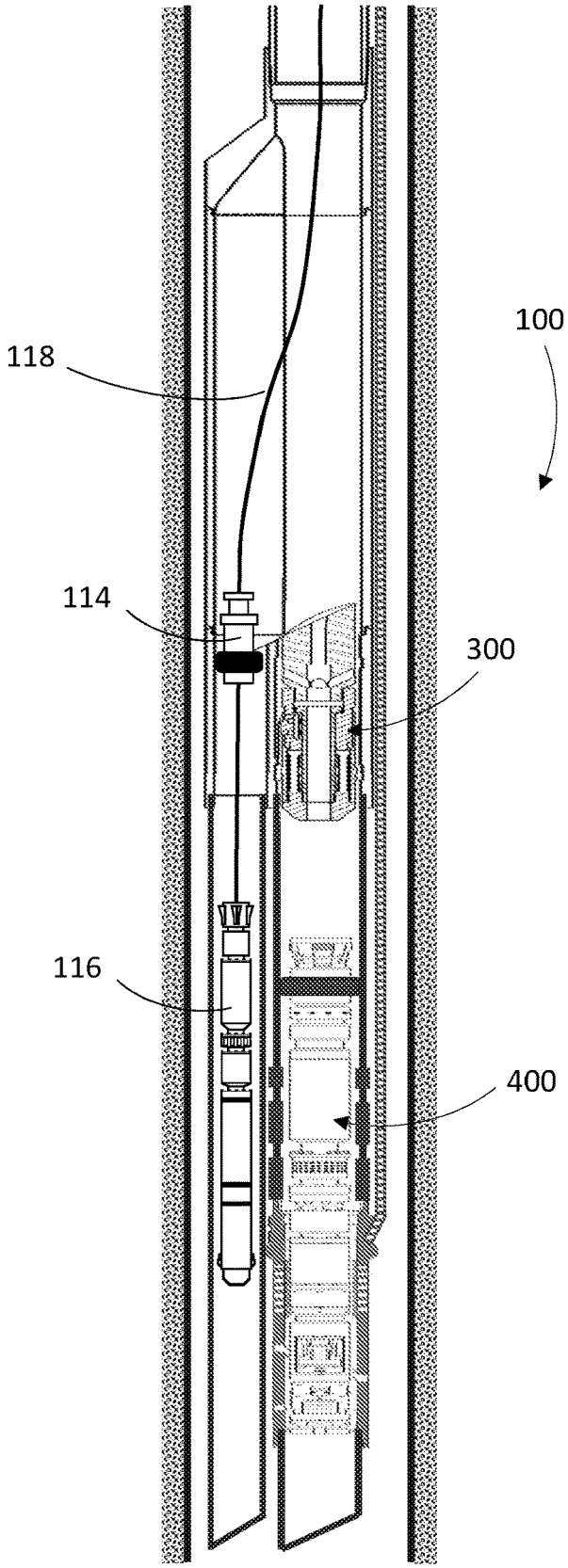
FIG. 3C is a cross-section view of the reverse Y-tool system showing the logging string descending from the production plug in the bypass bore, according to an embodiment of the disclosure.

Turning now to FIG. 3C, this figure shows the logging string assembly 116 inside the bypass bore 110. In this figure, a survey plug 114 is shown anchored at the entry of the bypass bore 110, in the same position as the previous production plug 112. An anchoring mechanism keeps the survey plug 114 from continuing to move down through the bypass bore 110, and a release mechanism releasing the survey plug 114 from the top of the logging string 116, allows the logging string 116 to continue traveling down the well up to a target depth.

The function of the survey plug 114, is to seal the entry of the bypass bore 110 to avoid recirculation similar to the function of the production plug 112. But the survey plug 114 also allows the logging string 116 to continue to travel downhole.

Once the logging string 116 has finished the intended logging, logging string 116 and survey plug 114 are retrieved to surface, and a production plug 112 is installed again.

Figure 4A:
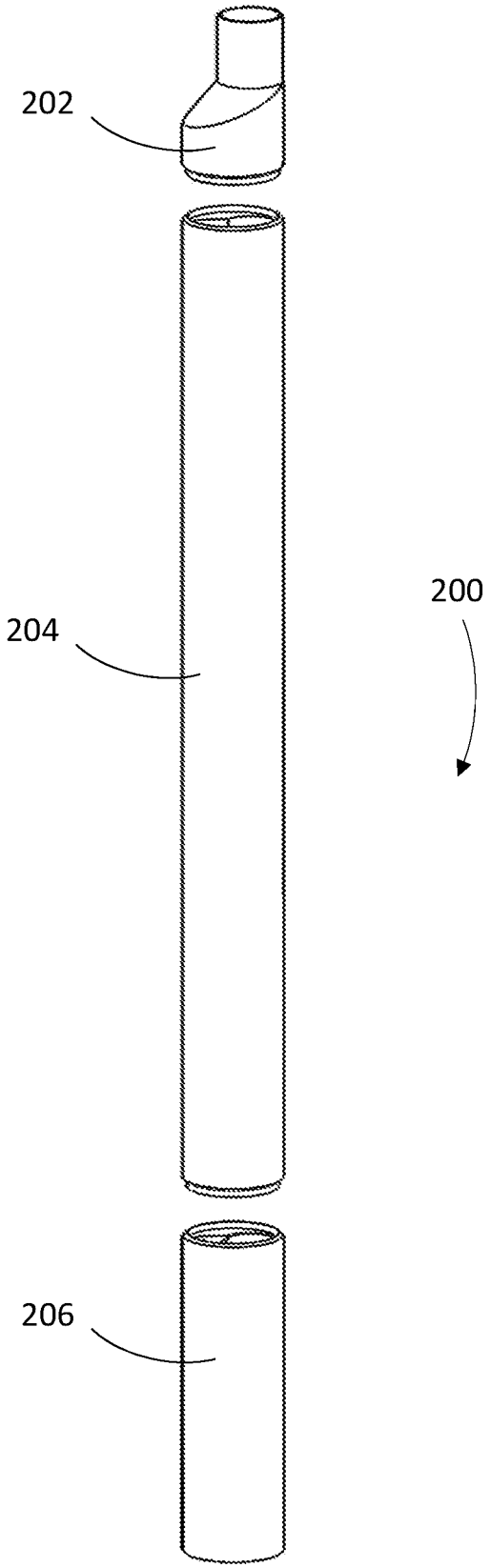
FIG. 4A is a perspective assembly drawing showing the modules of a reverse Y-tool mandrel, according to an embodiment of the disclosure.

Referring generally to FIG. 4A, this drawing shows an exemplary embodiment of the reverse Y-tool mandrel 200. In this embodiment, the reverse Y-tool mandrel 200 comprises a modular construction. The reverse Y-tool mandrel 200 may comprise an upper head 202 including a production tubing connection, a middle body 204 comprising a discriminating profile, and a bottom section 206 including a connection to production tubing as well as a connection to bypass tubing. This modularity allows for easier manufacturing, lower cost, and allows for easier inclusion of alignment and tool discriminating features.

Figure 4B:
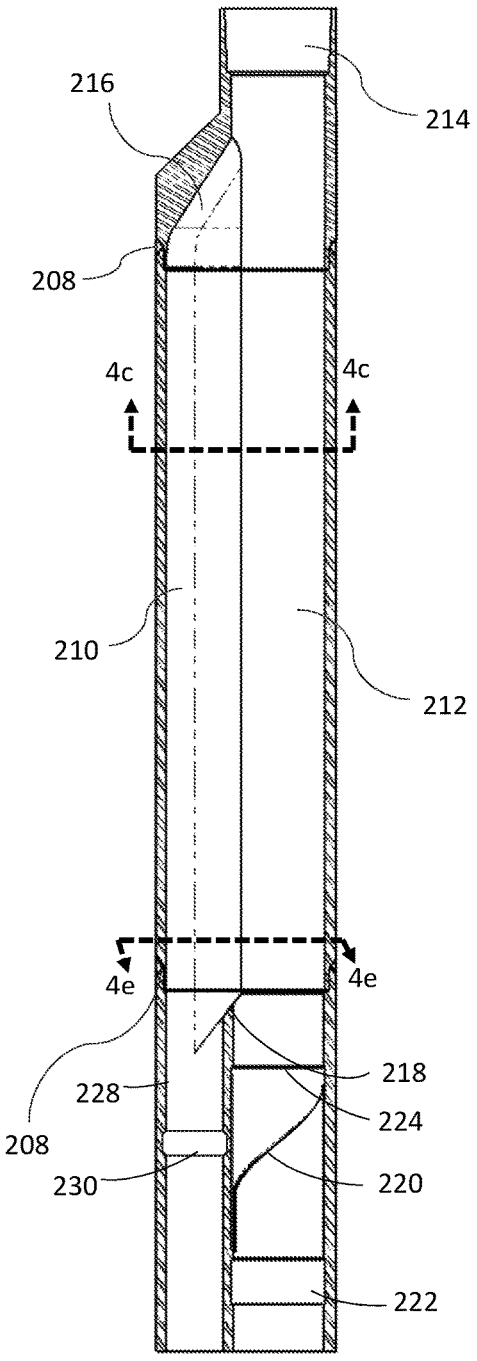
FIG. 4B is a cross-section of a reverse Y-tool mandrel, according to an embodiment of the disclosure.

Turning to FIG. 4B, the reverse Y-tool mandrel 200 is illustratively shown in cross-section as fitted with one entry bore 214 located at the top, and two exit bores located at the bottom. With regards to the two exit bores shown at the bottom of the reverse Y-tool mandrel 200, one of which is in-line with the entry hole, establishing a continuous bore as the main bore 212. Alternatively, the other exit bore is located parallel to and at the side of the main bore 212, and is referred to as the bypass bore 210.

The main bore 212 is designed to accommodate the configurations of the retrievable ESP system 400 and the orienting whipstock 300. The bypass bore 210 is to be used as a bypass route for loggings strings 116 or intervention tools to travel downhole around a retrievable ESP system 400.

One reason for the use of two bore configurations is the size and type of equipment used in the retrievable ESP pump 400. Pumps, seals, motors, downhole connectors, and other running equipment are generally longer and stiffer than logging tools and most e-line or slick line intervention equipment. Accordingly, locating a retrievable ESP pump 400 along the main bore 212 simplifies installation and removal of said components. Other wellbore components, such as logging tools, data recorders and other intervention equipment are run through the side bore 210, which may be smaller than the main bore 212. Due to the intended routing of the retrievable ESP pump 400 and logging tools, data recorders and other intervention equipment, specific design features in the reverse Y-tool mandrel 200 and supplementary equipment are needed to assist the function of guiding each component to the respective and intended bores.

At the top of the figure within the upper section 202 of the reverse Y-tool mandrel 200, a re-entry ramp 216 is machined to provide an easy transition when retrieving the logging string assembly 116. Traveling up hole through the side bore 210, a logging string assembly 116 would slidably engage the re-entry ramp 216 and be directed into the production tubing via the entry bore 214.

Figure 4C:
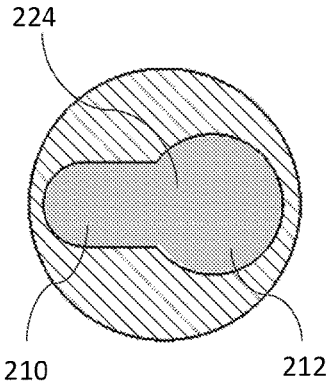
FIG. 4C is a sectional view of a reverse Y-tool mandrel looking downstream, according to an embodiment of the disclosure.

Weldments 218 are shown as located between the main components 202, 204, and 206. Referring to FIG. 4C, this section through the middle body 204 provides a cross-sectional view of the discriminating profile 224 comprising the main bore 212, the bypass bore 210, and a blended space between the two circular bores. Embodiments of this profile may function as a size discriminator for the retrievable ESP pump 400 as well as for the orienting whipstock 300, both of which have a larger diameter than that of the bypass bore 210 or the blended space between the two bores. The larger diameters of these components function to prevent said components from deviating to the incorrect bore, even in a deviated or horizontal orientation of the wellbore.

Embodiments of the main bore 212 of the bottom section 206 of the reverse Y-tool mandrel 200 may be fitted feature(s) that function to orient and interact with the orienting whipstock 300 and or the retrievable ESP pump 400. For example, in the embodiment shown in FIGS. 4B and 4F, an orienting profile 220 as well as two locking profiles, a lower locking profile 222, and an upper locking profile 224, and a guiding key channel 226, may be used.

Additionally, the bypass bore 210 may also be fitted with features that orient and interact with the production plugs, logging tools, data recorders, and other intervention equipment. In this embodiment, bypass bore 210 is shown as fitted with a polished bore 228 and a tool lock profile 230.

In this specific embodiment, the features mentioned in the main bore 212 serve to orient, actuate, position and lock the orienting whipstock 300 into position. The features described for the bypass bore 210, serve to actuate, lock and seal in together with the survey plug 114 and production plug 112.

Figure 4D:
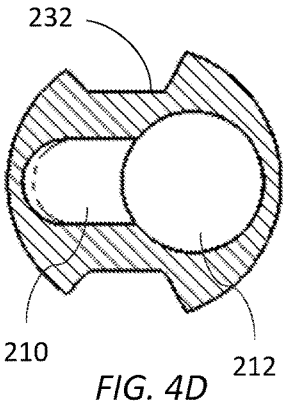
FIG. 4D is cross-sectional view of a reverse Y-tool mandrel, according to an embodiment of the disclosure.
Figure 4E:
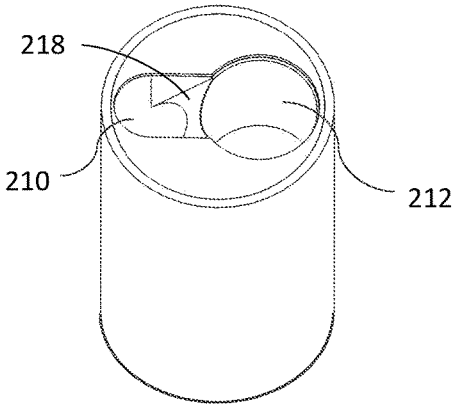
FIG. 4E is a perspective sectional view of a reverse Y-tool mandrel looking upstream at an entry point to the bypass bore, according to an embodiment of the disclosure.
Figure 4F:
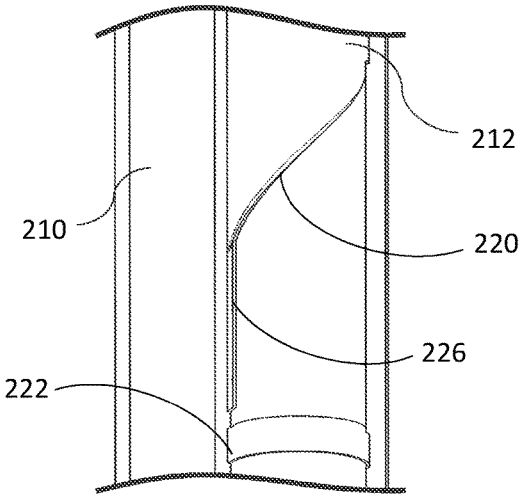
FIG. 4F is a cross-sectional view of a lower portion of the reverse Y-tool mandrel illustrating guiding and orienting components for the orienting whipstock, according to an embodiment of the disclosure.

A guiding ramp 218 shown in FIG. 4E serves as the transitioning point between the orienting whipstock 300 and the bypass bore 210. The guiding ramp 218 may further guide any logging tools, data recorders, and other intervention equipment and preventing a flat point on which the tools may get stuck. FIG. 4D shows an embodiment of a cross-section of a reverse Y-tool mandrel 800 comprising additional channels 232 in the exterior circumference to provide access to for an ESP cable (such as ESP power line 412) or to allow space for additional fluid flow around the reverse Y-tool mandrel 800.

Figure 5A:
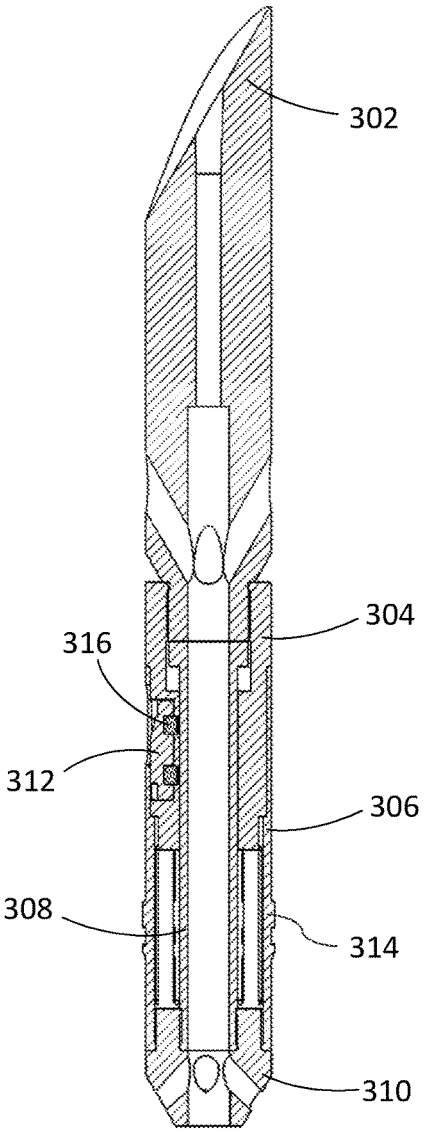
FIG. 5A is a cross-sectional view of the orienting whipstock in which a sliding sleeve is preventing a guiding key from deploying, according to an embodiment of the disclosure.
Figure 5B:
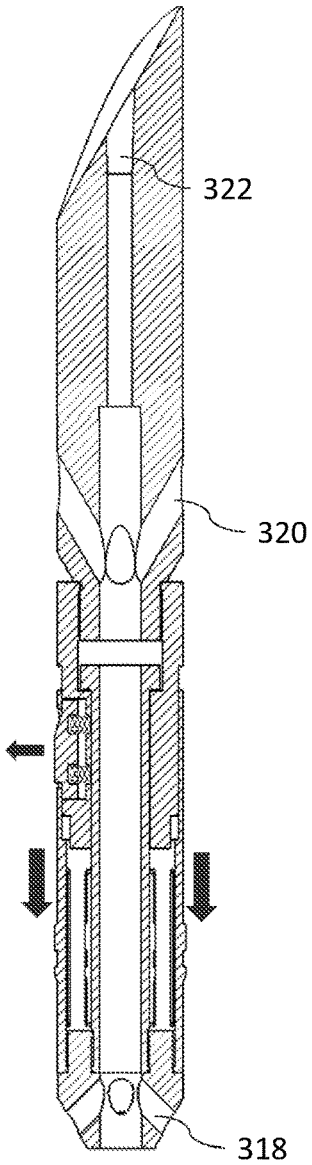
FIG. 5B is a cross-sectional view of the orienting whipstock of FIG. 5A in which the sliding sleeve has been moved and the guiding key is deployed, according to an embodiment of the disclosure.
Figure 5C:
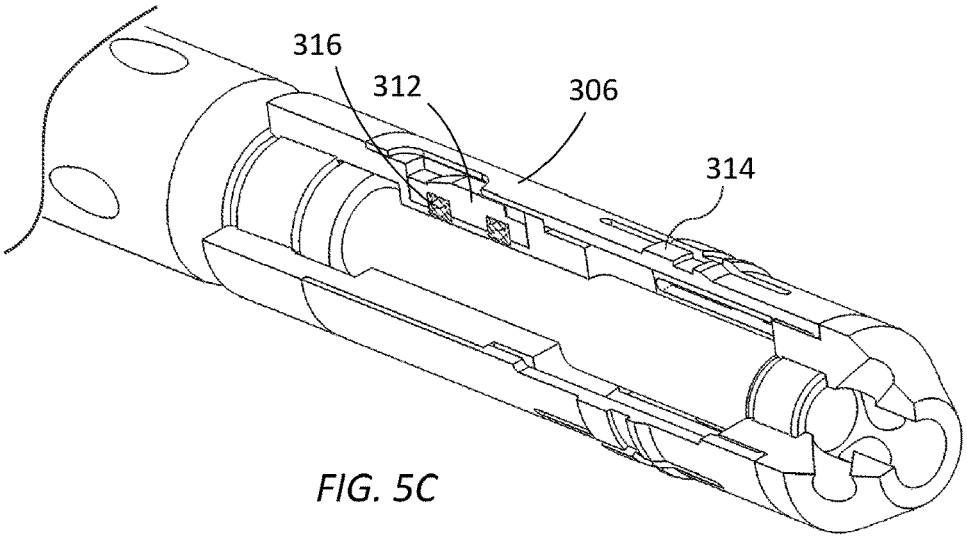
FIG. 5C is a cross-sectional perspective view of the orienting whipstock of FIG. 5A prior to deployment of the guiding key, according to an embodiment of the disclosure.

Turning now to FIGS. 5A, 5B, and 5C, these two cross-sectional and one cross-sectional perspective illustrative drawings show additional detail on an embodiment of the orienting whipstock 300. The top of FIG. 5A shows an angled head 302. The angled head 302 is configured to interact with a logging string 116 (for example) and direct the logging string 116 the appropriate bypass bore 210.

However, in order to function as a guide for the logging string 116, the head 302 needs to be properly aligned within the main bore 212. To facilitate alignment, this embodiment of the orienting whipstock 300 features a spring-loaded recessed guiding key 312. A sliding sleeve 306 is fitted with discriminating profile keys or collet 314.

The orienting whipstock 300 is lowered until the discriminating profile keys or collet 314 engage in the upper locking profile 224 of the reverse Y-tool mandrel 200. Tension applied to the orienting whipstock 300 shifts the sliding sleeve 306 downward, 'liberating' or releasing the guiding key 312 which resiliently protrudes radially outward from the orienting whipstock 300. In this embodiment, the guiding key 312 is resiliently motivated due to the expansion of springs 316 located between the the guiding key 312 and the rest of the orienting whipstock 300. Although the guiding key 312 is described as being activated by shifting a sliding sleeve 306, alternative methods of deploying the guiding key 312 such as pressure changes, electrical, mechanical, or hydraulic actuation, among others, may be used.

The guiding key 312 is configured to engage the orienting profile 220 in the reverse Y-tool mandrel 200, rotating and translating the orienting whipstock 300 until the guiding key 312 is directed inside of the guiding key channel 226. The discriminating profile locking keys or collet 314 then engage the lower locking profile 222 and prevent further downward movement of the orienting whipstock 300.

In other embodiments, the orienting whipstock 300 may have an orienting profile and a guiding key channel while the reverse Y-tool mandrel 200 comprises a guiding key. In such a case, the guiding key may be released or may be protruding at the time of deployment of the orienting whipstock 300.

Since the orienting whipstock 300 is located directly upstream of the ESP pump 400, production flow passage is required to occur through the orienting whipstock 300. Production flow enters the orienting whipstock 300 via nosepiece ports 318 and exits at the top of the orienting whipstock 300 via head ports 320.

Figure 6A:
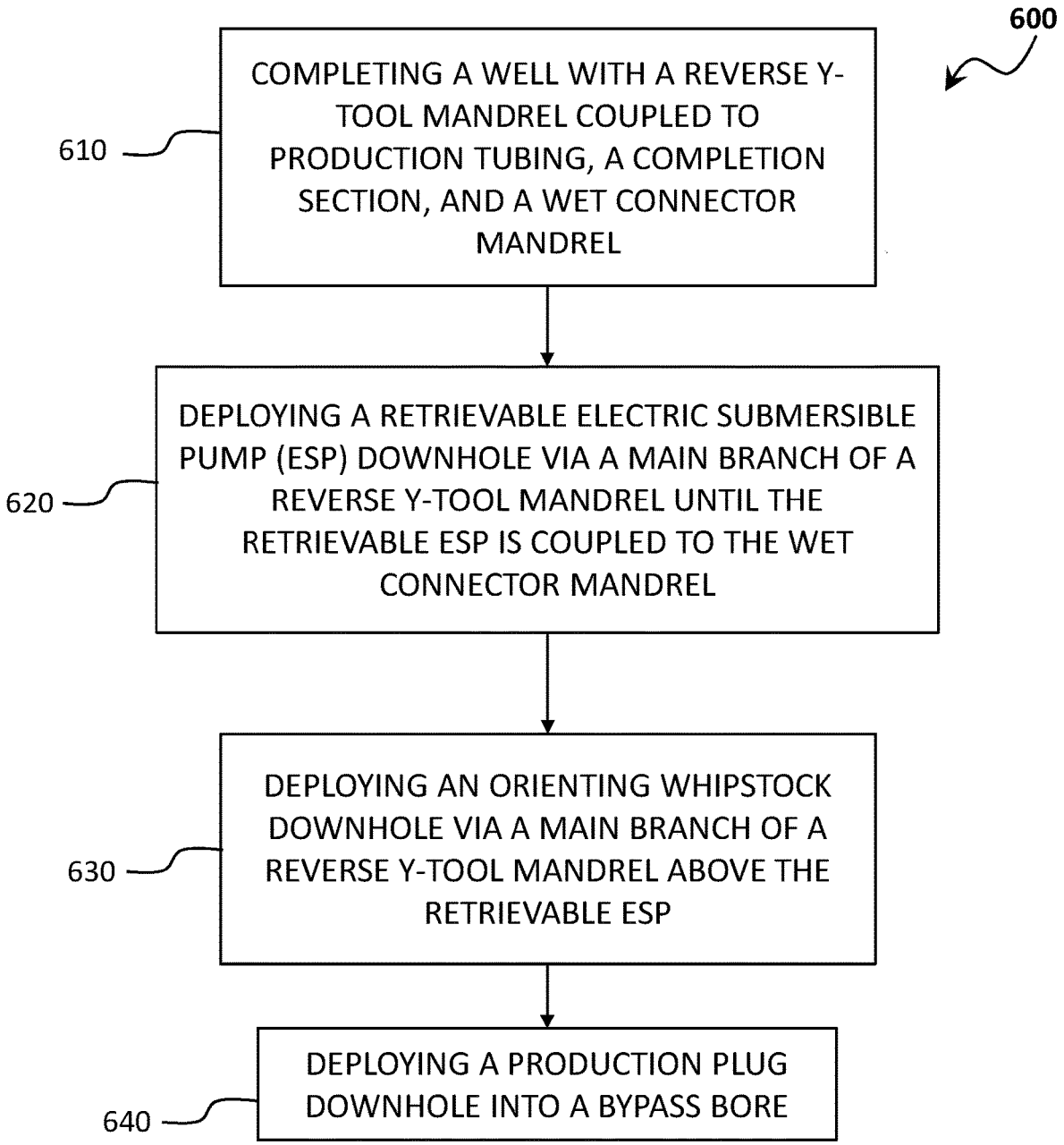
FIG. 6A is a flowchart illustrating a method for deploying a reverse Y-tool system, according to an embodiment of the disclosure.
Figure 6B:
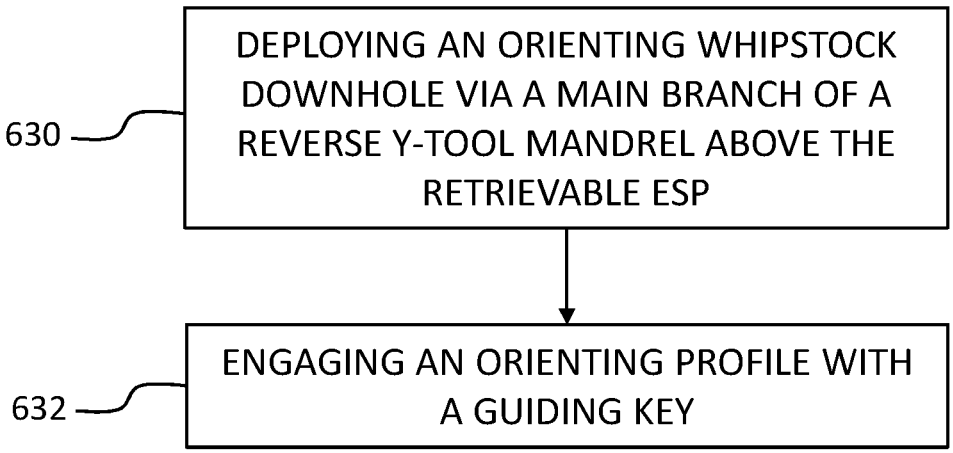
FIG. 6B is a flowchart detailing a method for deploying an orienting whipstock downhole via a main branch of a reverse Y-tool mandrel above the retrievable ESP, according to an embodiment of the disclosure.
Figure 6C:
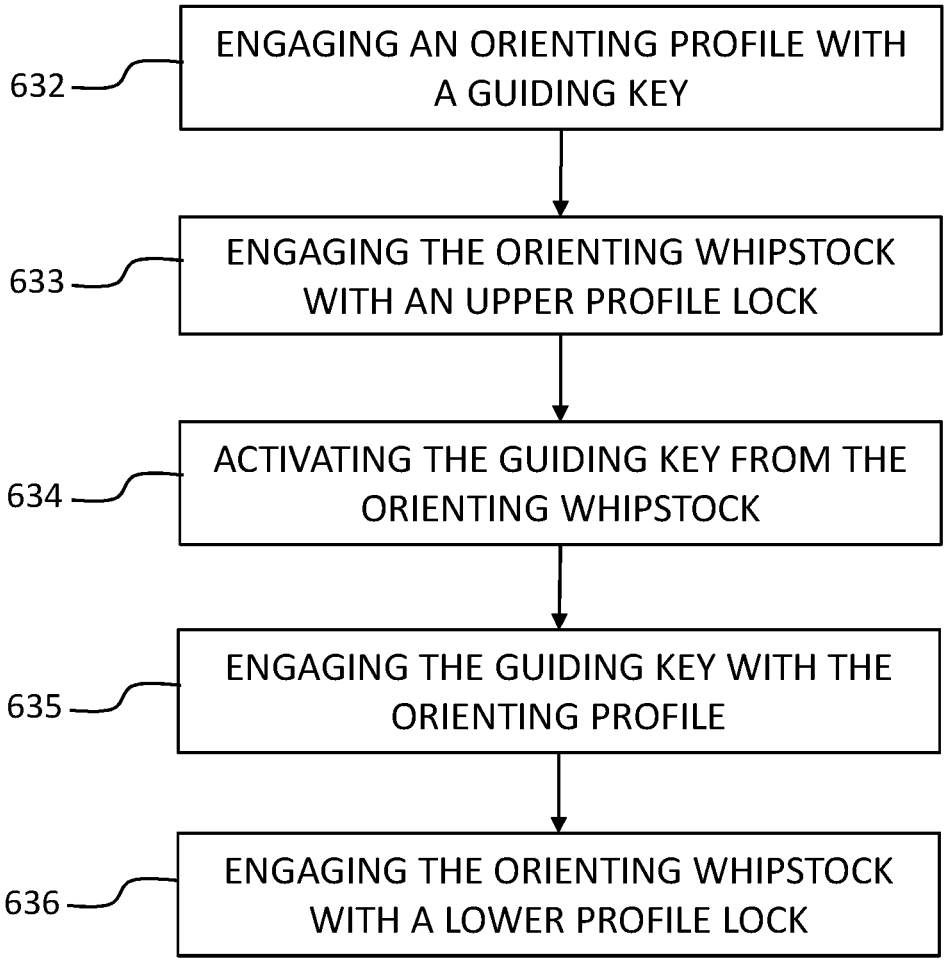
FIG. 6C is a flowchart detailing a method for engaging an orienting profile with a guiding key, according to an embodiment of the disclosure.

Referring generally to FIGS. 6A, 6B, and 6C, these figures illustrate an embodiment of a method for deploying a reverse Y-tool system 600. As shown in FIG. 6A, the method for deploying a reverse Y-tool system 600 may include completing a well with a reverse Y-tool mandrel coupled to production tubing, a completion section and a wet connector mandrel 610. Other components may also be coupled to the components listed. The method may further include deploying a retrievable Electric Submersible Pump (ESP) downhole via a main branch of a reverse Y-tool mandrel until the retrievable ESP pump is coupled to the wet connector mandrel 620, deploying an orienting whipstock downhole via a main branch of a reverse Y-tool mandrel above the retrievable ESP pump 630, and deploying a production plug downhole into a bypass bore 640.

Deploying an orienting whipstock downhole via a main branch of a reverse Y-tool mandrel above the retrievable ESP pump 630 may include engaging an orienting profile with a guiding key 632. As stated earlier, although shown with the orienting profile on the reverse Y-tool mandrel and the guiding key on the orienting whipstock, this is only for the purpose of description. The orienting profile and the guiding key can interchangeably located on the orienting whipstock and reverse Y-tool mandrel. Other methods and techniques for properly positioning and orienting the orienting whipstock as known to those of skill in the art may also be used.

Engaging an orienting profile with a guiding key 632 may be further detailed in some embodiments as shown in FIG. 6C as engaging the orienting whipstock with an upper profile lock 633 and activating the guiding key from the orienting whipstock 634. The method may further include engaging the guiding key with the orienting profile 635 and engaging the orienting whipstock with a lower profile lock 636.

Figure 7:
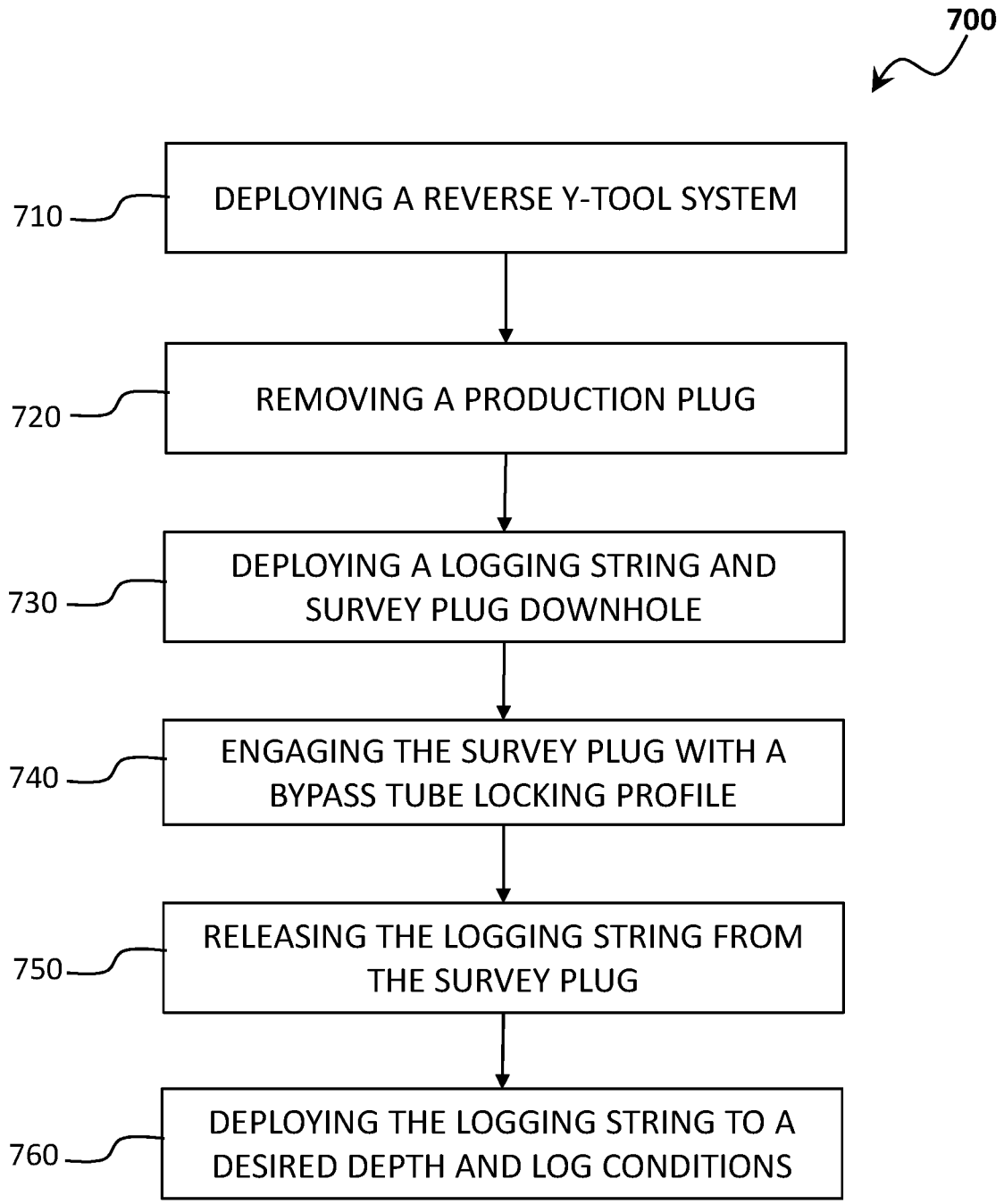
FIG. 7 is a flowchart illustrating a method for logging a well, according to an embodiment of the disclosure.

Turning to FIG. 7, this figure shows a representative flowchart for an embodiment of a method for logging a well 700. The method may include deploying a reverse Y-tool system 710, removing a production plug 720, and deploying a logging string and survey plug downhole 730. In addition, the method may include engaging the survey plug with a bypass bore locking profile 740, releasing the logging string from the survey plug 750, and deploying the logging string to a desired depth, and log conditions 760.

Although only a few example embodiments have been described in detail above, those skilled in the art will readily appreciate that many modifications are possible in the example embodiments without materially departing from this disclosure. Accordingly, all such modifications are intended to be included within the scope of this disclosure as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A reverse Y-tool system comprising:

a first tubing branch in line with production tubing;

a second tubing branch offset from the first tubing branch and configured to releasably couple with a production plug or a survey plug;

a retrievable Electric Submersible Pump (ESP) deployed in the first tubing branch;

an orienting whipstock deployed in the first tubing branch downstream of the retrievable ESP and configured to direct other wellbore components to the second tubing branch, wherein the orienting whipstock further comprises production flow ports to permit flow of a production fluid through the orienting whipstock;

wherein a radius of the second tubing branch is less than a radius of the first tubing branch.

2. The reverse Y-tool system of claim 1 further comprising:

a wet connector mandrel for providing power to the retrievable ESP.

3. The reverse Y-tool system of claim 2 further comprising an ESP power line electrically coupled to the wet connector mandrel.

4. The reverse Y-tool system of claim 1 further comprising a completion section provided in the first tubing branch.

5. A reverse Y-tool mandrel comprising:

an upper head comprising an upper connection to production tubing;

a middle body comprising a discriminating section profile, the discriminating profile further comprising a main circular bore of a first diameter, a bypass circular bore of a second diameter smaller than the first diameter, and a blended space between the main circular bore and the bypass circular bore; and a bottom section comprising a lower connection to production tubing and a lower connection to bypass tubing.

6. The reverse Y-tool mandrel of claim 5 wherein the upper head further comprises a re-entry ramp.

7. The reverse Y-tool mandrel of claim 5 wherein the bottom section further comprises an orienting profile.

8. The reverse Y-tool mandrel of claim 5 wherein the bottom section further comprises a locking profile for an orienting whipstock.

9. The reverse Y-tool mandrel of claim 5 further comprising a production flow channel in an exterior circumference.

10. A method for deploying a reverse Y-tool system comprising:

completing a well with a reverse Y-tool mandrel coupled to production tubing, a completion section, and a wet connector mandrel;

deploying a retrievable Electric Submersible Pump (ESP) downhole via a main branch of the reverse Y-tool mandrel until the retrievable ESP is coupled to the wet connector mandrel;

deploying an orienting whipstock downhole via a main branch of the reverse Y-tool mandrel above the retrievable ESP, wherein the orienting whipstock further comprises production flow ports to permit flow of a production fluid through the orienting whipstock; and deploying a production plug downhole into a bypass bore.

11. The method for deploying a reverse Y-tool system as claimed in claim 10, wherein deploying an orienting whipstock further comprises:

engaging an orienting profile with a guiding key.

12. The method for deploying a reverse Y-tool system as claimed in claim 11, wherein engaging the orienting profile with the guiding key comprises:

engaging the orienting whipstock with an upper profile lock;

activating the guiding key from the orienting whipstock;

engaging the guiding key with the orienting profile; and engaging the orienting whipstock with a lower profile lock.

13. The method for deploying a reverse Y-tool system as claimed in claim 11, wherein engaging the orienting profile with the guiding key comprises resiliently activating the guiding key to protrude from the orienting whipstock.

14. The method for deploying a reverse Y-tool system as claimed in claim 11, wherein engaging the orienting profile with guiding key comprises activating the guiding key by manipulating a sliding sleeve to release the guiding key.

15. The method for deploying a reverse Y-tool system as claimed in claim 10, wherein the retrievable ESP is powered from a remote location via the wet connector mandrel.

16. The method for deploying a reverse Y-tool system as claimed in claim 10, wherein the production plug is directed into the bypass bore by the orienting whipstock.

17. A method for logging a well comprising:

deploying a reverse Y-tool system;

removing a production plug;

deploying a logging string and survey plug downhole;

engaging the survey plug with a bypass bore locking profile;

releasing the logging string from the survey plug;

deploying the logging string to a desired depth and log conditions.

18. The method for logging a well claimed in claim 17 and further comprising:

directing the logging string and survey plug into a bypass bore via an orienting whipstock.

19. The method for logging a well claimed in claim 17, wherein the conditions are logged during production.

20. The method for logging a well claimed in claim 17, wherein the conditions are at least one of wellbore temperature, wellbore pressure, or flow rate of borehole fluid.

21. A reverse Y-tool mandrel comprising:

an upper head comprising an upper connection to production tubing;

a middle body comprising a discriminating section profile;

a bottom section comprising a lower connection to production tubing and a lower connection to bypass tubing; and a production flow channel in an exterior circumference.

22. A method for deploying a reverse Y-tool system comprising:

completing a well with a reverse Y-tool mandrel coupled to production tubing, a completion section, and a wet connector mandrel;

deploying a retrievable Electric Submersible Pump (ESP) downhole via a main branch of a reverse Y-tool mandrel until the retrievable ESP is coupled to the wet connector mandrel;

deploying an orienting whipstock downhole via a main branch of a reverse Y-tool mandrel above the retrievable ESP; and deploying a production plug downhole into a bypass bore;

wherein the step of deploying an orienting whipstock further comprises engaging an orienting profile with a guiding key by engaging the orienting whipstock with an upper profile lock;

activating the guiding key from the orienting whipstock;

engaging the guiding key with the orienting profile; and engaging the orienting whipstock with a lower profile lock.

23. A method for deploying a reverse Y-tool system comprising:

completing a well with a reverse Y-tool mandrel coupled to production tubing, a completion section, and a wet connector mandrel;

deploying a retrievable Electric Submersible Pump (ESP) downhole via a main branch of a reverse Y-tool mandrel until the retrievable ESP is coupled to the wet connector mandrel;

deploying an orienting whipstock downhole via a main branch of a reverse Y-tool mandrel above the retrievable ESP; and deploying a production plug downhole into a bypass bore;

wherein the step of deploying an orienting whipstock further comprises engaging an orienting profile with a guiding key by resiliently activating the guiding key to protrude from the orienting whipstock.

24. A method for deploying a reverse Y-tool system comprising:

completing a well with a reverse Y-tool mandrel coupled to production tubing, a completion section, and a wet connector mandrel;

deploying a retrievable Electric Submersible Pump (ESP) downhole via a main branch of a reverse Y-tool mandrel until the retrievable ESP is coupled to the wet connector mandrel;

deploying an orienting whipstock downhole via a main branch of a reverse Y-tool mandrel above the retrievable ESP; and deploying a production plug downhole into a bypass bore;

wherein the step of deploying an orienting whipstock further comprises engaging an orienting profile with a guiding key by activating the guiding key by manipulating a sliding sleeve to release the guiding key.

* * * * *